US007370768B2

(12) United States Patent
Chattey

(10) Patent No.: US 7,370,768 B2
(45) Date of Patent: May 13, 2008

(54) CRANE APPARATUS FOR DIRECT TRANSSHIPMENT OF MARINE CONTAINERS BETWEEN TRANSPORTATION MODES WITHOUT NEED OF GROUND PLACEMENT

(76) Inventor: Nigel Chattey, 22 Cederlawn Rd., Irvington-on-Hudson, NY (US) 10533-1924

( * ) Notice: Subject to any disclaimer, the term of this patent is extended or adjusted under 35 U.S.C. 154(b) by 0 days.

(21) Appl. No.: 11/823,792

(22) Filed: Jun. 28, 2007

(65) Prior Publication Data

US 2007/0246437 A1 Oct. 25, 2007

Related U.S. Application Data

(63) Continuation of application No. 09/992,704, filed on Nov. 14, 2001, now abandoned.

(60) Provisional application No. 60/275,335, filed on Mar. 13, 2001, provisional application No. 60/248,274, filed on Nov. 14, 2000.

(51) Int. Cl.
*B63B 27/12* (2006.01)

(52) U.S. Cl. ..... 212/270; 212/325; 414/140.3

(58) Field of Classification Search ..... 212/270, 212/325; 414/140.3, 141
See application file for complete search history.

(56) References Cited

U.S. PATENT DOCUMENTS

| | | | | | |
|---|---|---|---|---|---|
| 1,190,822 | A | * | 7/1916 | Vandvevelde | 414/140.5 |
| 1,305,802 | A | * | 6/1919 | Hulett | 414/141.7 |
| 1,346,068 | A | * | 7/1920 | Vaughan | 212/74 |
| 1,476,557 | A | * | 12/1923 | Travell | 212/325 |
| 1,547,536 | A | * | 7/1925 | Van Der Graaf et al. | 414/140.3 |
| 2,799,403 | A | * | 7/1957 | Friedman | 212/83 |
| 3,247,974 | A | * | 4/1966 | Dechantsreiter | 414/591 |
| 3,812,987 | A | * | 5/1974 | Watatani | 414/561 |
| 4,018,349 | A | * | 4/1977 | Hupkes | 414/561 |
| 4,106,639 | A | * | 8/1978 | Montgomery et al. | 414/141.3 |
| 4,172,685 | A | * | 10/1979 | Nabeshima et al. | 414/139.7 |
| 4,293,077 | A | * | 10/1981 | Makino | 212/325 |
| 4,750,429 | A | * | 6/1988 | Mordaunt et al. | 104/98 |
| 5,769,589 | A | * | 6/1998 | Lubbers | 414/268 |
| 5,775,866 | A | * | 7/1998 | Tax et al. | 414/140.3 |
| 5,951,226 | A | * | 9/1999 | Fantuzzi | 414/141.3 |

FOREIGN PATENT DOCUMENTS

| | | | |
|---|---|---|---|
| JP | 64-60596 | * | 3/1989 |
| JP | 9-255282 | * | 9/1997 |
| JP | 10-279279 | * | 10/1998 |
| NL | 1001548 | * | 5/1997 |

* cited by examiner

*Primary Examiner*—Thomas J. Brahan
(74) *Attorney, Agent, or Firm*—Adams & Wilks

(57) ABSTRACT

A crane apparatus is installed on a pier, wharf, bulkhead wharf or other foundation extending into the water for directly transshipping containers from a vessel moored alongside the foundation to another transportation mode without necessity of ground placement of the containers. The crane apparatus includes a parent crane displaceable along the foundation for unloading containers from a vessel moored alongside the foundation and placing the containers on a first platform of the parent crane, and a sibling crane displaceable along the foundation beneath the parent crane independently of displacement of the parent crane for loading containers from the first platform onto over-the-ground vehicles. The parent crane has a first trolley/spreader hoist movable along a first boom for unloading containers from the vessel and placing them on either the first platform or a second platform of the parent crane, and a second trolley/spreader hoist movable along a second boom for loading containers from the second platform onto another vessel or over-the-ground vehicles.

13 Claims, 11 Drawing Sheets

CRANE APPARATUS FOR DIRECT TRANSSHIPMENT OF MARINE CONTAINERS BETWEEN TRANSPORTATION MODES WITHOUT NEED OF GROUND PLACEMENT

CROSS REFERENCE TO RELATED APPLICATIONS

The present application is a continuation of prior U.S. application Ser. No. 09/992,704, filed on Nov. 14, 2001 now abandoned, which claims the benefit of provisional Application Ser. Nos. 60/248,274 filed Nov. 14, 2000 and 60/275,335 filed Mar. 13, 2001, which are hereby incorporated by reference, and priority thereto for common subject matter is hereby claimed.

BACKGROUND OF THE INVENTION

The present invention relates generally to container cranes, and more particularly to a crane apparatus for directly transshipping containers between transportation modes without the need for placing the containers on the ground.

The volume of worldwide containerized cargo is increasing faster than is the capacity of many of the world's conventional marine container terminals. The problem is being compounded by a shortage of terminal space and increasing congestion caused by traditional, ship/stack/trailer-truck type operations. In addition, air pollution problems in and around marine terminals, most notably in older port cities such as New York, Los Angeles, Rotterdam and Hamburg, now dictate that major changes are needed in the method of handling marine container cargoes.

One solution to these problems would come from logistics systems that enable the direct transshipment of containers between transportation modes, i.e., without the need for their ground placement before they leave the terminal. For example, direct transshipment between container ships and feeder vessels, barges, ferries, etc., and direct transshipment between container ships and container unit-trains.

Modern examples of port/rail container terminal facilities are those in Los Angeles (Pier 400 and the Alameda Rail Corridor Project) and ECT at Maasvlacht. The ECT project is being linked to the Ruhr District in Germany by a new rail tunnel and railroad being constructed in connection with Deutsche Bahn.

Both these terminals, however, currently involve indirect ship to unit-train transshipment container logistics systems, i.e., the dockside cranes move the containers from the ship via one or more types of ground transportation units to a container stacking yard. Such ground transportation units are either manned (driver driven) or automated transfer systems. Examples are: Gaussin S.A.'s multi-trailer sets (MTS); BUISCAR's system; automated guided vehicles (AGVs) such as those of Siemens/Demag and, more recently, 1-over-1 shuttle straddle carriers such as those of Kalmar Industries. Because these transfer systems move the containers from dockside to intermediate container stacking areas within the marine terminal, they are classed as INDIRECT, as against DIRECT, transshipment systems.

Various types of mobile container lifting equipment, such as rubber tired gantries (RTGs) or rail mounted gantries (RMGs), then transfer the containers from these ground transportation systems and stack the containers in the terminal's stack, or storage, areas. Here the containers wait until a unit-train comes into, or near-by, the marine terminal, at which time various types of mobile container lifting equipment again lift the containers and load them onto the rail-cars. There are therefore a minimum of three handlings of the container in such an indirect "on-dock" rail transshipment logistics system. Often the need to sort containers between stacks can lead to a further two or three additional handlings of a container.

One recent advance has been to automate the container stacking/unstacking functions within the terminal. This is exemplified by the Hessenatie/Siemens/Demag overhead automated bridge crane stacking system now being built in the Port of Antwerp and by the PSA automated terminal system in Singapore.

These systems, while certainly increasing container handling productivity within terminals, whether manned or automated, are still only component parts of indirect transshipment systems.

By contrast, DIRECT, as against INDIRECT, transshipment of containers between ship and other transportation modes (such as container feeder vessels, barges and/or container unit-trains and other over-the-ground equipment) requires that such multiple handling be avoided. This can only be done if the quayside container crane is designed to move the container to these other transportation modes directly, without the necessity of ground placement, thereby eliminating, to the maximum extent possible, the need for container stacking within the terminal.

In turn, this can only be done by a totally new system of container handling and logistics. Specifically by the use of multiple hoists (together with one or more platforms) within a "parent" quayside container crane. In addition, for the direct transshipment of containers between ship and container unit-trains and other over-the-ground equipment, an independent but associated "sibling" crane must work in conjunction with its parent quayside container crane.

Such a sibling crane must be able to move independently under and on either side of its parent crane. As such, by moving independently along the quay, or wharf, it can load rail-cars (or other over-the-ground equipment) even though its parent crane has to remain in a fixed position while unloading any particular cell of a container vessel.

The mobile parent quayside container cranes working in conjunction with their associated sibling cranes according to this invention, hereinafter sometimes referred to as the Poseidon™ crane system, achieve the direct transfer of containers between all these transportation modes without the necessity of ground placement, within the shortest possible cycle distance, and in the shortest possible cycle time.

The sibling cranes in this invention can be either rubber-tired gantry cranes (RTGs) or rail-mounted gantry cranes (RMGs). In practice, however, because of the narrow conditions, and for control and safety reasons, the optimal cranes to use should be RMGs.

Another major consideration is that, as the size and draft requirements of container vessels continue to increase, many relatively shallow ports are no longer able to receive such vessels. This is particularly true on the U.S. East and Gulf coasts. The economies of scale achievable by the use of these larger ships, however, is forcing a dramatic change in planning for the future. The concept of centralized hub terminals, dedicated to a single shipping company or Alliance, and capable of taking the deepest draft container ships, which then transship containers to container unit-trains and/or to feeder vessels and/or barges for their movement to shallower ports, is now being actively explored by shipping companies, terminal companies and port authorities around the world. In the the United States, this trend is exemplified by Maersk/Sealand's decision to possibly leave its major U.S. East Coast hub in the Port of New York/New Jersey for a deep-water, 568 acre, site they have purchased in Portsmouth, Virginia, a decision being forced by the multi-billion dollar cost of trying to deepen the channel to its existing facilities in Port Elizabeth, N.J.

As a result of these changes in marine container logistics systems, there is a parallel need being generated for new types of container handling and transshipping equipment. This invention, for a parent quayside container crane with its associated sibling crane, is designed to enable the direct transshipment of marine containers without the necessity of ground placement. The invention is particularly useful for direct transshipment of marine containers between container ships and (1) other marine modes such as feeder ships, barges, ferries, etc. and (2) over-the-ground vehicle modes including (a) railway modes, such as single-stack and double-stack container unit-trains, (b) all types of wheeled over-the-ground equipment, manned or automated, and (c) trailer-trucks and multi-trailer sets.

The crane apparatus comprised of cooperating parent and sibling cranes according to the present invention is designed to operate optimally on piers, including "J" "L" and "T" piers, wharves, bulkhead wharves, etc.

SUMMARY OF THE INVENTION

One object of the present invention is to provide a crane apparatus for the direct transshipment of marine containers between transportation modes and which overcomes the aforementioned drawbacks associated with prior art crane systems.

Another object of the present invention is to provide a crane apparatus having one or more sets of parent and sibling cranes operable in synchronization to effect transverse and longitudinal transshipment of containers between transportation modes without the necessity for ground placement of the containers.

A further object of the present invention is to provide a crane apparatus for the direct transshipment of marine containers between transportation modes and which has higher lift per hour rates of containers to or from a vessel than prior art crane systems.

These as well as other objects, features and advantages of the invention are realized by a crane apparatus having multiple hoists and container platforms within a parent crane and its independent, but associated, sibling crane that, as these cranes are operated in synchronization, allows for the transverse and longitudinal transshipment of containers between all transportation modes without the necessity of ground placement of the containers.

This system of multiple hoists and container platforms allows the parent crane to remain in any fixed position while unloading/loading a container ship as fast as possible, i.e., without having to be involved in numerous time-consuming, short distance, moves back and forth along the pier or wharf. The parent crane can remain in a fixed position as long as necessary, for example, in order to complete the unloading/loading cycle for any single cell on the container ship. It can remain in its fixed position whatever moves subsequently have to be made by the other modes in the overall transshipment cycle, i.e., specifically whatever moves have to be made by other marine vessels or by container unit-trains or by other over-the-ground vehicles.

The advantages of this direct transshipment system include the following:

1. Faster turn-around time for the container ship resulting from the high lift/hour rates of the parent cranes.

2. Direct loading of on-going land modes from the terminal, or in-coming land modes to the terminal, resulting in quicker turn-around times for such equipment.

3. Less dwell-time, and more secure dwell-time, of containers within the terminal.

4. Less overall lift and transfer cost of containers in and out of the terminal.

The Poseidon™ crane system thus provides substantial cost savings to both container shipping companies and container terminal operators.

The foregoing as well as other objects, features and advantages of the invention will become readily apparent to those of ordinary skill in the art upon a reading of the following detailed description of the invention when read in conjunction with the accompanying drawings.

DETAILED DESCRIPTION OF THE INVENTION

Figure 1:
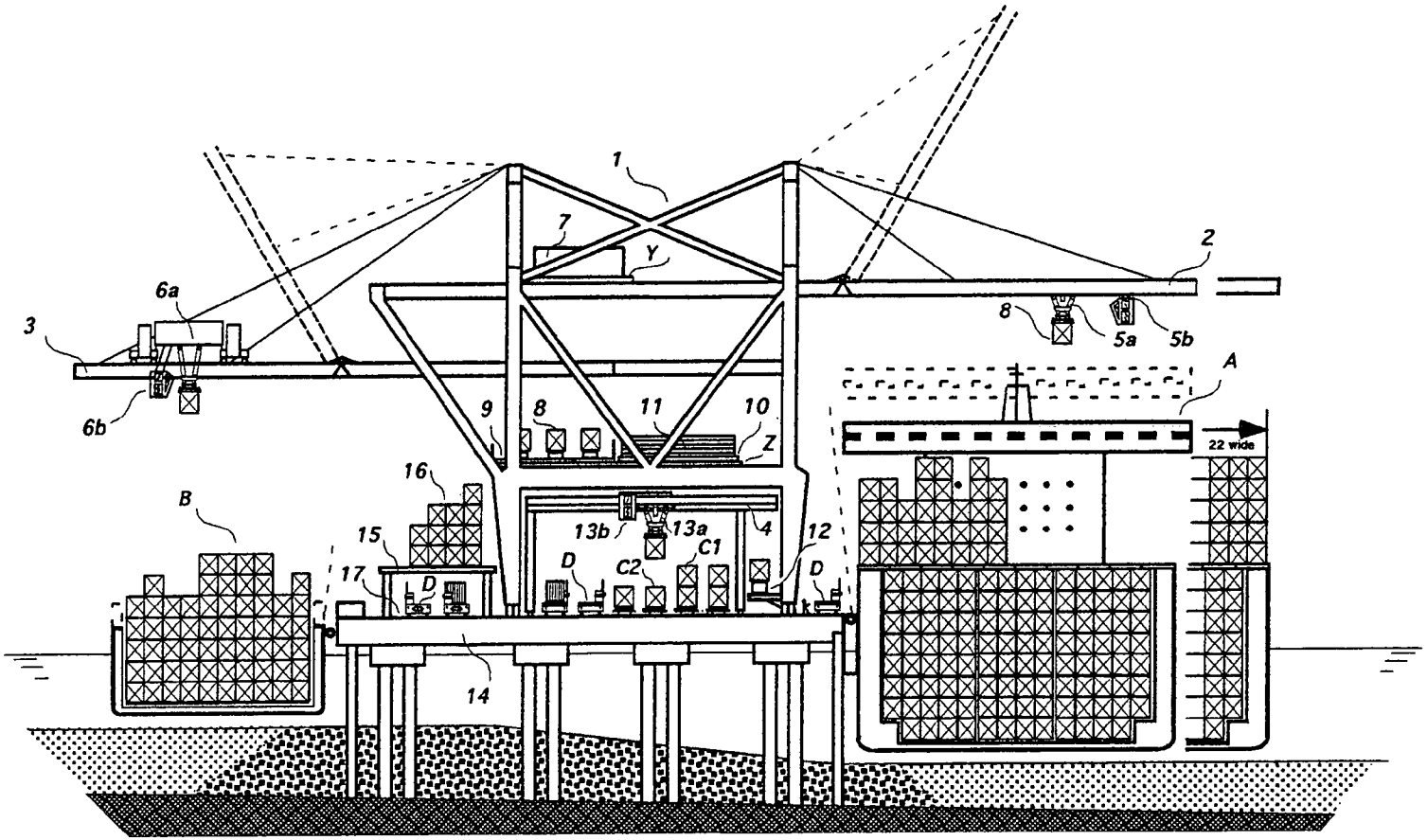
FIG. 1 is an explanatory elevational view, partly in section, of one embodiment of crane apparatus according to the present invention, showing a parent quayside container crane and its associated sibling rail-mounted gantry crane (RMG crane), both mobile on rails, mounted on a standard-type pier constructed, for example, on the slab, plinth and piling principle, and illustrating the manner in which these cranes are able to transship containers directly between various transportation modes without the necessity for ground placement.

The present invention relates to crane apparatus for effecting the direct transshipment of containers between transportation modes without the need for placing the containers on the ground. The crane apparatus comprises one or more sets of parent and sibling cranes, which are movable independently of one another, in synchronization, to directly transship containers between transportation modes. For ease of description, the embodiments of the invention described hereinafter show only one set of parent and sibling cranes, it being understood that in practice there will be two, three, four or more sets of parent and sibling cranes operating at the same time, depending on the size and type of container vessel being loaded/unloaded. Throughout the drawings, the same or like elements are denoted by the same reference characters.

One embodiment of the invention is illustrated in FIG. 1, which shows crane apparatus comprising a parent quayside container crane 1 together with its associated sibling RMG crane 4, both of which are movable on ground level trackwavs such as rails along a pier 14. As explained hereinafter, the parent crane 1 cooperates with the sibling crane 4 to effect the direct transshipment of containers 8 between container ships A (of whatever size and beam) and (1) other marine modes B, such as river/harbor barges or feeder vessels (or, as is more likely in the United States, coastal tug-barge systems); and/or (2) double-stack rail cars C2; and/or (3) other modes of over-the-ground equipment D.

As shown in FIG. 1, the mobile parent quayside container crane 1 has two crane booms 2 and 3 placed on opposing sides thereof and built into, and part of, its overall structure. The boom 2 carries a rope trolley/spreader hoist 5*a* (or alternatively a machine trolley) and an independently mounted operator control cabin 5*b*. The boom 3 carries a machine trolley/spreader hoist 6*a* and an independently mounted operator control cabin 6*b*. At least two platform bearing structures Y and Z are built into the overall structure of the mobile parent quayside container crane 1. If the boom 2 carries a rope trolley/hoist spreader, then a rope trolley/hoist driving motor and winch room 7 is located on the platform bearing structure Y. A fixed platform 9 for receiving containers 8 and a fixed platform 10 for receiving hatch covers 11 are both located on the platform bearing structure Z. The fixed platform 9 is designed to enable twist-lock crews to unlock, and lock, the twist-locks on the containers 8 when necessary.

The parent guayside container crane 1, which is displaceable lengthwise along the pier on its own ground level rails, has associated with it the sibling rail-mounted gantry crane (RMG) 4, which is independently displaceable lengthwise along the pier 14 on its own ground level rails. The sibling RMG crane 4 is capable of operating under, and in conjunction with, the parent crane 1, but independently of it, for a given distance on either side of the parent crane, without interfering with the other parent quayside container cranes 1 and their sibling RMG cranes 4 (not shown) as they may also be operating on either side along the same pier 14.

The sibling RMG crane 4 is mounted on its own set of rails, independent of the rails upon which the mobile parent quayside container crane 1 is mounted. As such, the sibling RMG crane 4 can travel back and forth along the pier 14, under any position of its mobile parent crane 1 as, for example, while the parent crane 1 is in a fixed position unloading or loading a particular cell of a container ship. The actual distance that the sibling RMG crane 4 can travel along the pier 14, under and on either side of its parent crane 1, when the crane 1 is in a fixed position, however, is determined by the distance that similar sibling RMG cranes 4 are also working along the same pier 14 on either side under their respective parent cranes 1.

The parent crane 1 has a fixed receiving platform 12 for containers 8 on one side of, and fixed to the structure of, the crane 1. The platform 12 is designed to enable twist-lock crews to unlock and lock the twist-locks on the containers 8 when necessary.

The sibling RMG crane 4 has working within it, and operating at right angles to the rail-mounted movement of the crane 4 along the pier 14, a trolley/spreader hoist 13*a* and an operator control cabin 13*b*.

Figure 7:
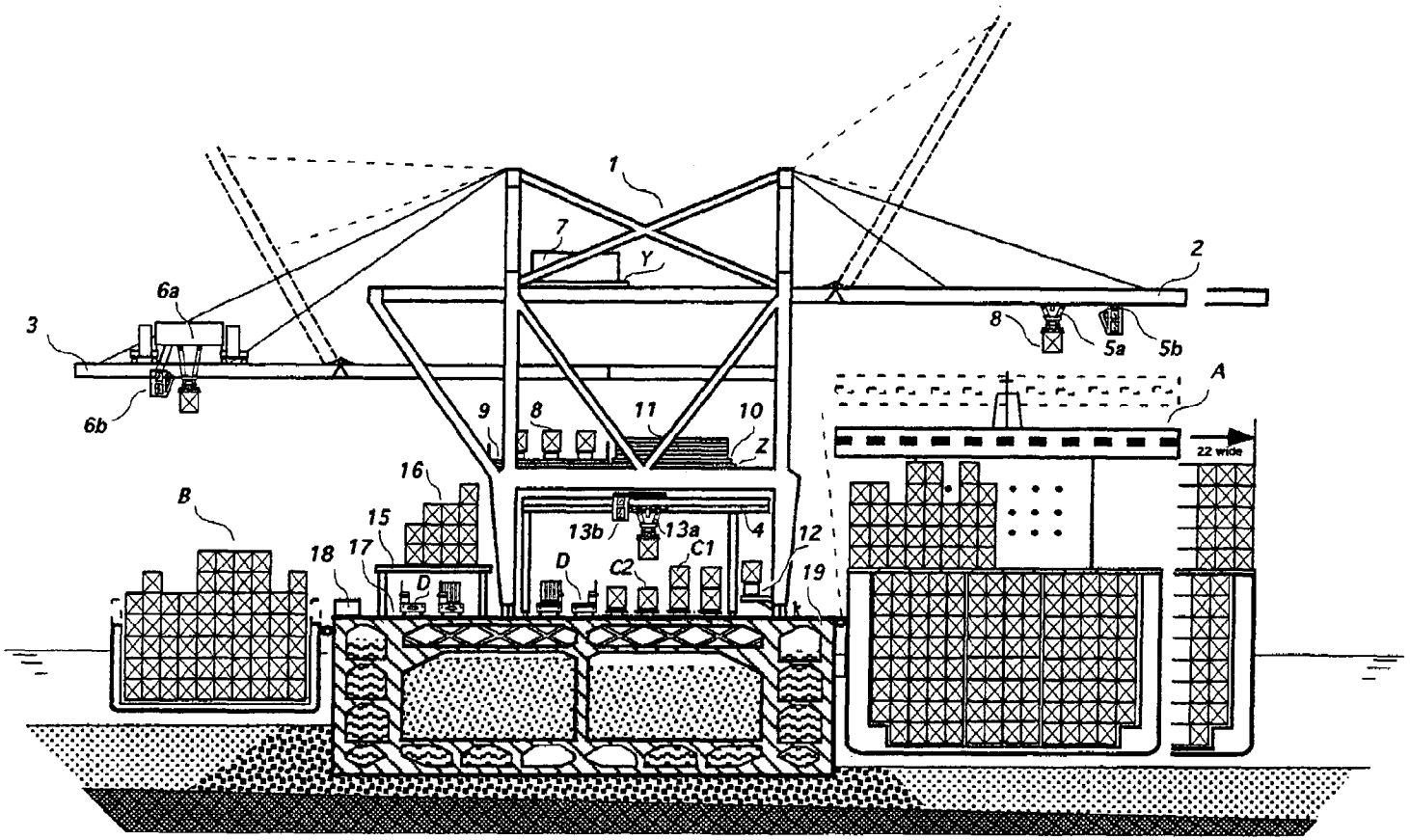
FIG. 7 is an explanatory elevational view, partly in section, of another embodiment of crane apparatus according to the present invention, showing the crane apparatus mounted on a caisson and illustrating the transshipping of containers between all the modes illustrated in FIG. 1 as well as the direct transshipment between each mode individually, as illustrated in FIGS. 2 through 5.

Each mobile parent crane 1, and each mobile sibling RMG crane 4 associated with it, together with their rails and power systems, are capable of being mounted on piers, either standard type piers, for example, of the slab, plinth and piling type 14 as shown in FIG. 1, or caisson piers 19, as shown in FIG. 7.

In this embodiment of the invention, and in order to lessen the width, and therefore the capital investment cost, of the pier 14, it is preferable to construct a raised platform 15 along the pier on which can be placed containers 16 awaiting re-stow aboard the container ship A. The raised platform 15 not only shortens the cycle time for such re-stowing of containers 16 but also creates a transportation corridor 17 (under the platform 15) for use by over-the-ground vehicles, such as yard-tractors D, etc.

It should be noted that the raised platform 15 is a stand-alone fixed structure running along the pier 14, and is in no way connected to the mobile parent cranes 1 or the mobile sibling RMG cranes 4 which must be free to move past the platform 15, up and down the pier 14.

FIG. 1 shows an embodiment of the invention in which the mobile parent cranes 2. and their mobile sibling RNG cranes 4 are mounted on and displaceable along trackways in the form of rails on a the pier 14. Alternatively, as shown in FIG. 7, the mobile parent cranes 1 and their mobile sibling RMG cranes 4 can be mounted on trackways on a wharf, or a bulkhead wharf, built either by conventional methods or again, as constructed by caissons 19.

When the Poseidon™ crane system of the invention is placed on a wharf or bulkhead wharf, the option is available as to whether the raised platform 15, and the over-the-ground vehicle transportation corridor 17 that is under it, should or should not be constructed. This decision will depend on the layout of the backland of the terminal. If sufficient space is available, then containers 16, awaiting restowing aboard the container vessel A, can be stacked on the ground by the machine trolley/spreader hoist 6*a* on the boom 3, and the transportation corridor 17 can be located landside of the restow stacks.

Figure 2:
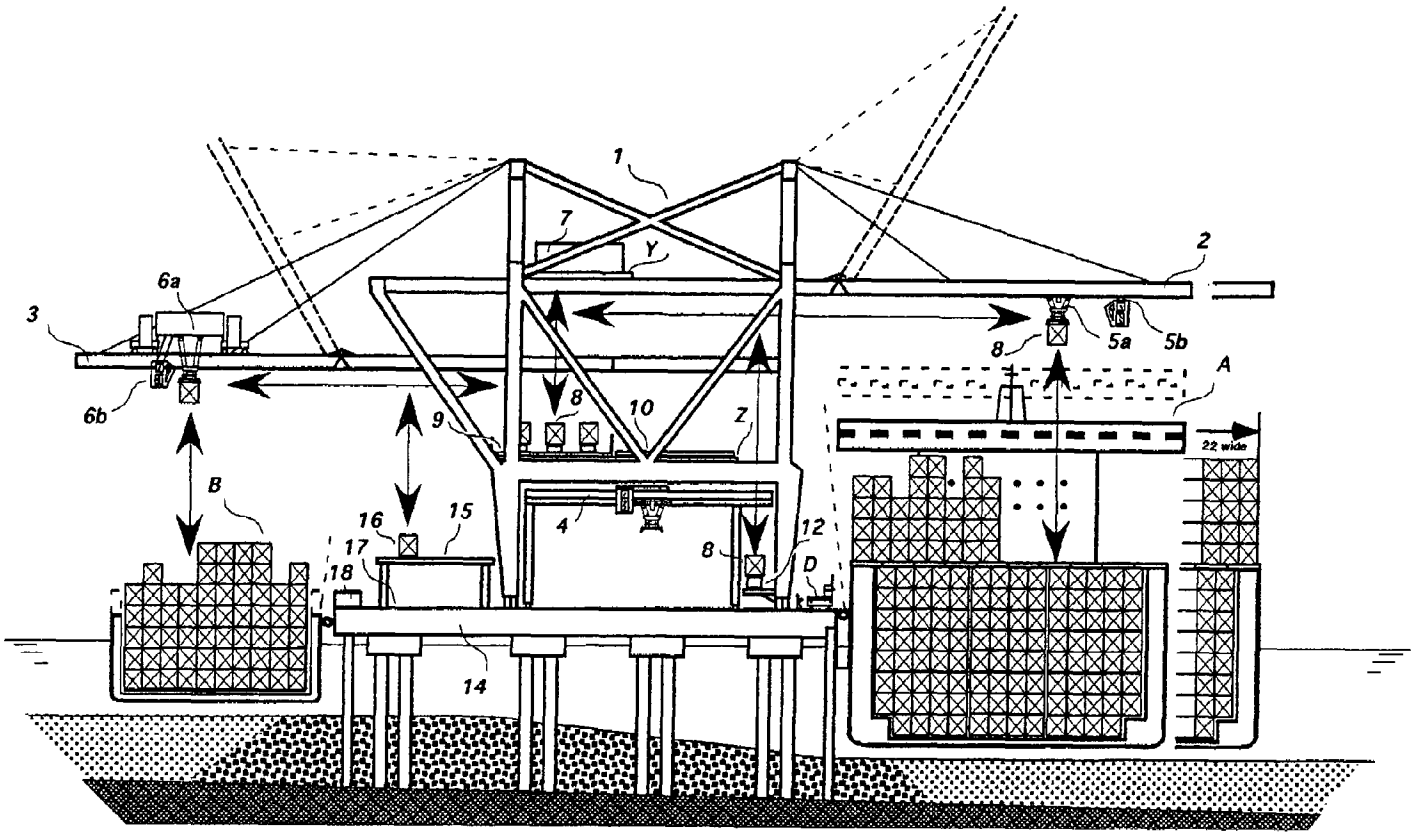
FIG. 2 is an explanatory elevational view, partly in section, of another embodiment of crane apparatus according to the present invention, showing the crane apparatus mounted on a standard-type pier and showing the transshipping of containers from a container vessel directly to other marine mode vessels such as, for example in this case, to a river/harbor barge or to a feeder vessel (or, as is more likely in the United Sates, a coastal tug-barge system), without the necessity for ground placement.

FIG. 2 illustrates an embodiment of the crane apparatus of the invention used to directly transship containers 8 across a pier 14, between a container ship A and other marine modes B, such as river/harbor barges, ferries, etc., and for example specifically in this case, to a container feeder vessel (or, as is more likely in the United Sates, to a coastal container tug-barge system).

The cycle time for unloading a container is made up of basically two movements, vertical and horizontal. Over the same travel distance, and when acceleration and de-acceleration times are taken into account, vertical movements of containers take approximately twice as long as horizontal movements.

As container ships have increased in size, the vertical movements over which a container has to move have also increased. When working such large vessels, the cycle time of single-hoist dock-side container cranes is now too long, i.e., at between 120 and 150 seconds on average in the United States.

If the cycle time is to be shortened, multiple hoists must cycle concurrently within the crane and, as importantly, these multiple hoists must operate with platforms within the crane. For example, in FIG. 2 are shown fixed container platforms 9, 10 and 12 constructed as integral structural parts of the mobile parent crane 1.

The overall cycle time for transshipping a container 8 is shortened by the fact that the first trolley/spreader hoist 5*a* on the boom 2 has only to move the container 8 out of the ship A to the platform 9, high up in the crane, or to the platform 12 which is close to the dock-front. In either case the travel distance for containers is considerably shortened when compared to the distance that containers would have to travel within single-hoist cranes of similar outreach.

From the platform 9, the machine trolley/spreader hoist 6*a* on the boom 3 only has to move either (1) a container to the marine vessel B moored on the inside face of the pier, or (2) a container 16 to the re-stow stacking platform 15 (which is immediately adjacent to the back legs of the mobile parent cranes 1). Either of these movements is undertaken while the first trolley/spreader hoist 5*a* on the boom 2 is returning to lift another container 8 from the container ship A.

From the platform 12, as shown in FIG. 1, the trolley/spreader hoist 13*a* in the sibling RMG crane 4 only has to move the container 8 either (1) to rail-cars C1 or C2 on the rails running under both cranes, or (2) to other over-the-ground vehicles D, similarly positioned under both cranes. Again, either of these movements can be undertaken at the same time the first trolley/spreader hoist 5*a* on the boom 2 is returning to lift another container 8 from the container ship A.

When the Poseidon™ crane system of FIG. 1 is operating under conditions of maximum synchronization, the cycle time in transshipping containers should be as low as 50 seconds, i.e, less than half the time achievable by even state-of-the-art single-hoist quayside gantry cranes, such as those now being built in China by ZPMC.

A more detailed description of the movements of the containers within the cranes 1 and 4 will be given with reference to FIG. 2, which shows the loading and unloading sequence of containers between container ship A and other marine vessels B.

The trolley/spreader hoist 5*a* on the boom 2, under the control of an operator stationed in the independently mounted operator control cabin 5*a*, lifts the container 8 from the container ship A and transfers it to the fixed container receiving platform 9. On release of the container 8 at the fixed container receiving platform 9; the trolley/spreader hoist 5*a* can immediately return to lift another container 8 from the ship A.

As soon as the trolley/spreader hoist 5*a* on the boom 2 has cleared the fixed container receiving platform 9, the machine trolley/spreader hoist 6*a* on the boom 3, under control of an operator stationed in the independently mounted operator control cabin 6*b*, lifts the container 8 off the fixed container receiving platform 9 and transfers the container 8 to either the marine vessel B moored on the inside face of the pier 14 or to the re-stow stacking platform 15 as a re-stow container 16 for subsequent return of the re-stow container 16 to the platform 9, and from there back into the container ship A by the trolley/spreader hoist 5*a* on the boom 2.

The combination of the two trolley/spreader hoists 5*a*, 6*a* working in concert under the above-described sequence indicates that the mobile parent quayside container crane 1, when transshipping containers 8 between a container ship A and vessels B (such as river/harbor barges, container feeder vessels, or a coastal tug-barge system) should achieve a sustained lift rate in excess of 60 lifts an hour. For comparison purposes, 30 lifts an hour is considered an efficient sustained rate in the United States with single-hoist quayside container cranes.

The importance of this increase in lift rate, and decrease in cycle time, in transshipping containers is of considerable economic and operational importance, especially as these relate to the time taken in the management of the overall supply chain. For example, deployment of a Maersk Class "5" or "K", nominally rated 6,800 TEU capacity, container ship between Kaohsiung, Taiwan and the Port of New York, could see unloading/loading the entire nominal cargo of 13,600 containers of this vessel in 48 hours or less, as against 96 hours with standard single trolley/spreader hoist cranes.

For a given annual supply chain volume of 500,000 containers or more a year, the savings in this example, in port time each voyage, can result in being able to eliminate one entire vessel in the supply chain. At a $100+ million capital cost per vessel, in addition to ship crew costs, fuel costs, port fees, etc., the economic and operational incentives to convert to multiple hoist cranes according to the present invention becomes very real.

An additional, and important, consideration has to be taken into account. The initial position of the mobile parent cranes 1 over respective cells in the container ship A is not necessarily in alignment with the container cells in container feeder vessels or coastal tug-barge systems B moored on the other side of the pier 14. If misalignment is under 2.5 feet or 0.75 meters on either side, a standard trolley/spreader hoist can be designed to adjust for such transverse distances.

When misalignment is greater than 2.5 feet or 0.75 meters in either direction, additional alternatives have to be considered:

1. As container feeder vessels become larger (they are already at 1,200 TEU capacity in the Far East), and coastal tug-barge systems become larger (they are already at 800 TEU capacity in the United States), one alternative that can be considered is a system of "warping mules". Warping mules have been used since the early 1900's on the Panama Canal. Modern warping mules can be installed along the side of the pier 14. It is now well within the state-of-the art to design warping mules capable of moving, and aligning, even the largest container feeder vessels or coastal tug-barge systems B.

2. A second alternative to be considered is to design the cells of the feeder vessel or coastal tug-barge system with the same horizontal clearance distances between cells as those on the container ship A. Once such a feeder vessel or coastal barge is securely moored at the right place on the side of pier 14, its cells, and those of the container ship A on the opposite side of pier 14, will be in alignment. All mobile parent quayside container cranes 1 working the container ship A will then be in direct alignment with the cells on the feeder vessel or coastal tug-barge systems B. The problem here, however, is that the number of containers coming out of a single cell of a large container ship A greatly exceeds the number of containers that a single cell can accommodate on a feeder vessel or tug-barge system B. Therefore moving the smaller vessels along the pier will still be required.

3. In order to minimize the number of movements feeder vessels or tug-barges have to make, another alternative can be considered: In FIGS. 1 and 2, it will be noted that the trolley/spreader hoist 5*a* on the boom 2 has to be able to drop (and raise) containers 8 onto (and from) the platform 9 on the bearing platform Z. Similarly, the trolley/spreader hoist 5*a* has to be enabled to drop (and raise) container vessel hatch covers 11 onto (and from) the platform 10 also on the bearing platform Z. It will be noted also that the boom 3, supporting its trolley/spreader hoist 6*a*, lies above the bearing platform Z. In other words, the containers 8 and the hatch covers 11 have to pass through the boom 3 and its supporting structure. This, in turn, requires that the boom 3 be wide enough to accommodate such passages through it by the containers 8 and the hatch covers 11. However, the necessity of having to provide a much greater width in the boom 3, as against the boom 2, presents an opportunity to solve the misalignment problem referred to previously.

The optimum solution to the problem of misalignment between cells on either side of the pier 14 comes from making the width of the boom 3 wide enough to accommodate the machine trolley/spreader hoist 6*a*. Specifically, the boom 3 should be wide enough to accommodate a machine trolley/spreader hoist 6*a* capable of moving the containers 8 both in a transverse direction across the axis of the pier 14, and also longitudinally (parallel) to the axis of pier the 14. A further design option, inherent in this invention, is to make the longitudinal traverse of the machine trolley/spreader hoist 6*a* capable of loading/unloading containers 8 to/from two adjacent cells of the feeder vessels or tug-barge systems B.

As shown in FIGS. 1 and 2, these embodiments of the invention, from a terminal operations standpoint, makes practical, and cost-efficient, the direct transshipment of containers between container ships and other marine vessels moored on opposing sides of a pier and, more specifically, by enabling this function to be undertaken without the necessity of ground placement of any of the containers being transshipped.

Figure 3:
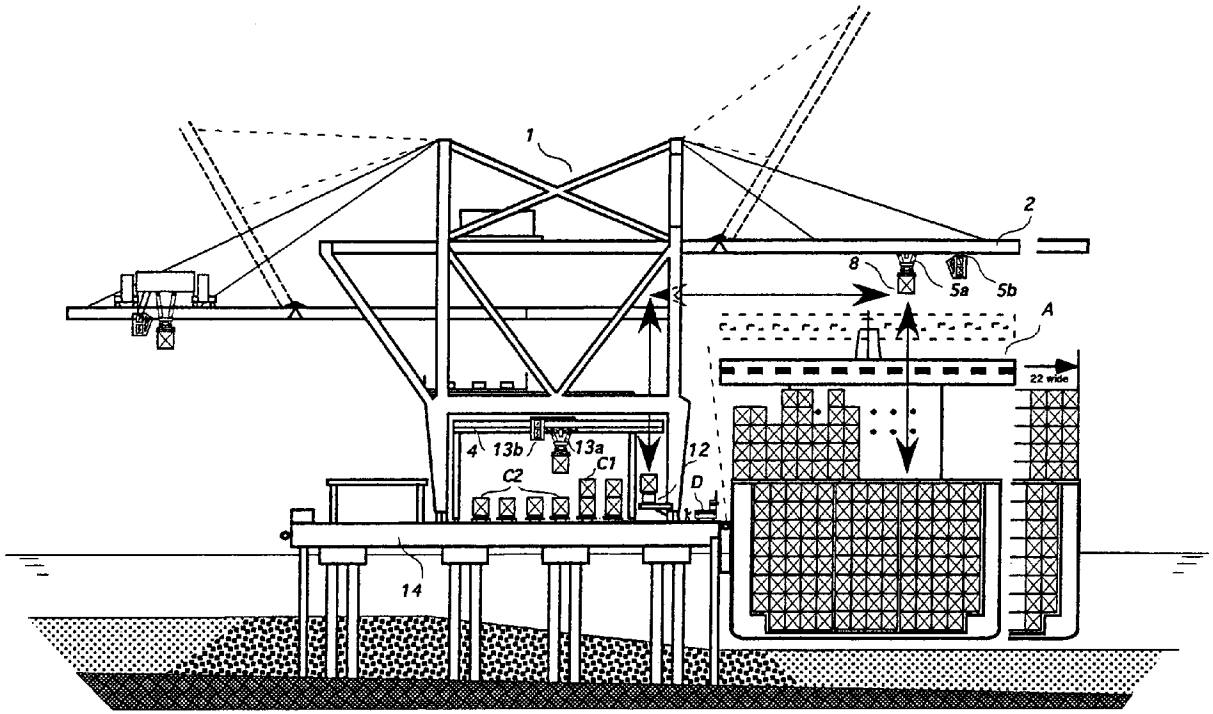
FIG. 3 is an explanatory elevational view, partly in section, of another embodiment of crane apparatus according to the present invention, showing the crane apparatus mounted on a standard-type pier and showing the transshipping of containers from a container vessel directly to the railway mode such as, for example in this case, to single-stack and double-stack rail-cars comprising cuts of container unit-trains standing on the pier on railway tracks immediately under the cranes, again without the necessity for ground placement.
Figure 3A:
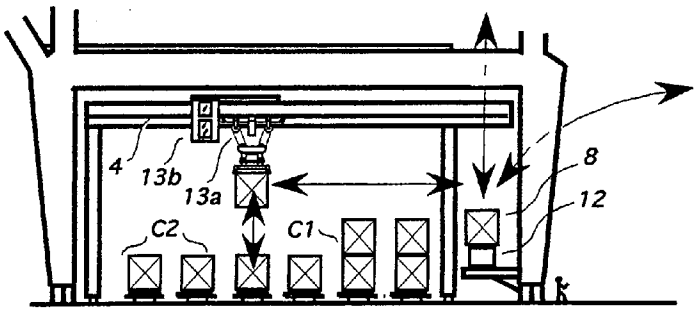
FIG. 3*a* is an enlarged view of part of the crane apparatus of FIG. 3 showing the unloading/loading cycle of the sibling crane.

FIGS. 3 and 3*a* illustrate an embodiment of the crane system of the invention whereby mobile parent quayside container cranes 1 and their sibling RMG cranes 4 transship containers 8 between a container ship A and railway modes, for example, between the container ship A and double-stack container rail-cars C1, and/or single-stack container rail-cars C2. The rail-cars, in both instances, form cuts of container unit-trains standing on the pier 14 immediately under the mobile parent quayside container cranes 1 and their sibling RMG cranes 4.

In this embodiment of the invention, part of the container unloading/loading cycle is shown in FIG. 3, i.e., the trolley hoist/spreader 5*a* under the control of an operator stationed in the independently mounted operator control cabin 5*b* lifts the container 8 from the container ship A and transfers it to the fixed container receiving platform 12. The platform 12 is an integral structural part of the mobile parent quayside container crane 1 and is attached to the legs of the crane 1 at the ship side thereof.

The on-going part of the unloading/loading cycle is shown in the enlarged view of FIG. 3*a*. The trolley hoist/spreader 13*a* mounted on the sibling RMG crane 4 lifts the container 8 from the container receiving platform 12 and transfers it to one of the double-stack C1, or single-stack C2, container rail-cars comprising cuts of container unit-trains on the pier 14 immediately under the cranes.

Figure 4:
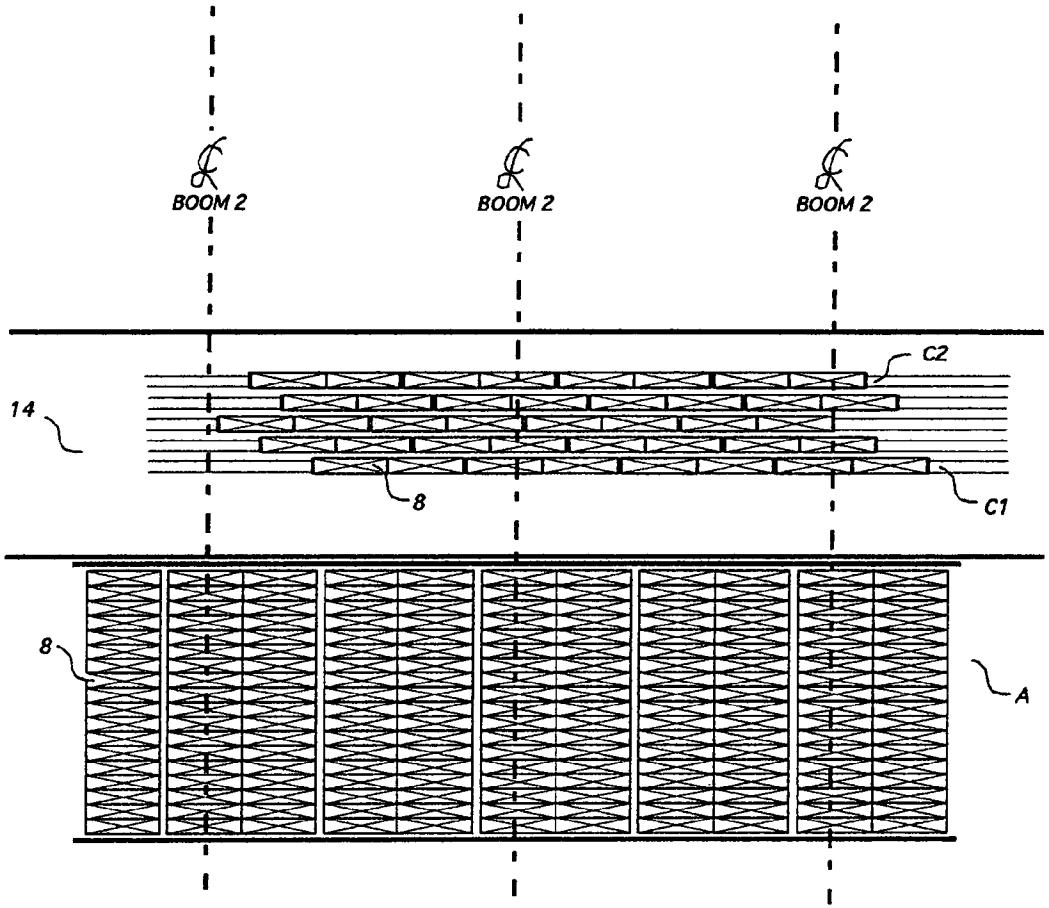
FIG. 4 is an explanatory plan view of a container ship alongside a pier, illustrating the manner in which several parent quayside container cranes directly transship containers to rail-cars on the pier.

The reason that only an independent sibling RMG crane 4 can properly execute this last transfer now becomes apparent and will be explained with reference to FIG. 4. FIG. 4, which is a plan view of the pier 14, shows a number of mobile parent quayside container crane booms 2 working to unload a container ship A and also shows, for example, five parallel rail tracks aligned under the cranes along the pier 14. On these five rail tracks, however, the position of individual rail-cars, either double-stack C1 or single-stack C2, can be out of alignment with the mobile parent cranes 1 and the booms 2 and also out of alignment with any single position of the sibling RMG cranes 4.

More specifically, as shown in FIG. 4, the booms 2 of the parent quayside container cranes 1 are shown aligned over the container cells of the ship A. At the same time, however, the crane booms 2 are seen to be out of direct alignment with the rail-cars C1 or C2 on the pier 14—especially when these rail-cars, as shown, comprise different cuts of container unit-trains. Because of this misalignment, the direct loading of rail-cars by parent quayside cranes 1 (without the necessity of ground placement) can only be achieved if these cranes were to make continuous movements back and forth along the dock. This explains why a sibling RMG crane 4 (associated with its parent quayside crane 1) and able to move longitudinally up and down the dock, is needed if such continuous, and uneconomic, short movements by parent quayside cranes are to be eliminated.

For this reason, only the independent sibling RMG cranes 4 have the full longitudinal and transversal range to reach all drop-off positions under their parent cranes 1. By their independence, the sibling RMG cranes 4 can transfer the containers 8 longitudinally, and transversally, along and across the pier 14 to any position of the rail-cars C1 or C2, independently of any fixed position of their parent cranes 1.

The sibling RMG cranes 4 operating from under, and out to the sides of, their mobile parent quayside container cranes 1, however, must be controllable so that they do not collide with either containers 8 being lowered to (or raised from) the platform 12 by their parent cranes 1 or other sibling RMG cranes 4 working under, and out to the sides of, their mobile parent quayside container cranes 1. This can be achieved by standard state-of-the-art automated control systems controlling the position of each sibling RMG crane 4 as it must relate to the position of its parent crane and the cranes 1 and 4 on either side of it.

From an operational standpoint, the following trend in container terminal logistics is important. Specifically, as container ships continue to increase in size, the need also increases to unload and load these vessels as quickly as possible. Direct loading of containers onto other modes is the most efficient and cost-effective way to do this. However such direct loading dictates that each on-going mode is loaded randomly. For example, all rail-bound containers should be loaded randomly, and as quickly as possible, on any available vacant rail-car immediately under the cranes. Sorting by ultimate rail destination should not be attempted at the dock-side. Once cuts of rail-car unit trains are loaded they should be moved as quickly as possible to a point within, or near, the terminal, where the cuts can be formed into container unit-trains. Once these unit-trains are formed, they should be moved, also as quickly as possible, away from the terminal area to the nearest interior marshalling yard. It is at these key interior marshalling yards that consolidation of the containers by ultimate rail destination should take place.

At least five of the world's largest container ports are already building rail systems back from their main container terminals to achieve essential parts of the needed new ship to rail container logistics systems—Rotterdam and Antwerp in Europe, Los Angeles and Long Beach in the United States and Deltaport (Vancouver) in Canada. The drive to do this is coming largely from the increasing truck congestion in and around these port cities. These new rail systems are multi-billion dollar investments, as attested to by the Alameda Rail Corridor Project in California at $2.0 billion, and the equally ambitious Deutsche Bahn rail line and tunnels being built to connect the Ruhr with the Port of Rotterdam via the interior container marshalling yard at Barendrecht in the Netherlands.

Once these, and similar, rail systems are completed, the only missing link will be to provide the direct loading and unloading of containers to and from cuts of rail-car unit-trains positioned immediately under the dockside cranes. It is a primary object of the present invention to provide this essential final link in the new container supply-chain logistics systems that, of necessity, are having to be developed.

Figure 5:
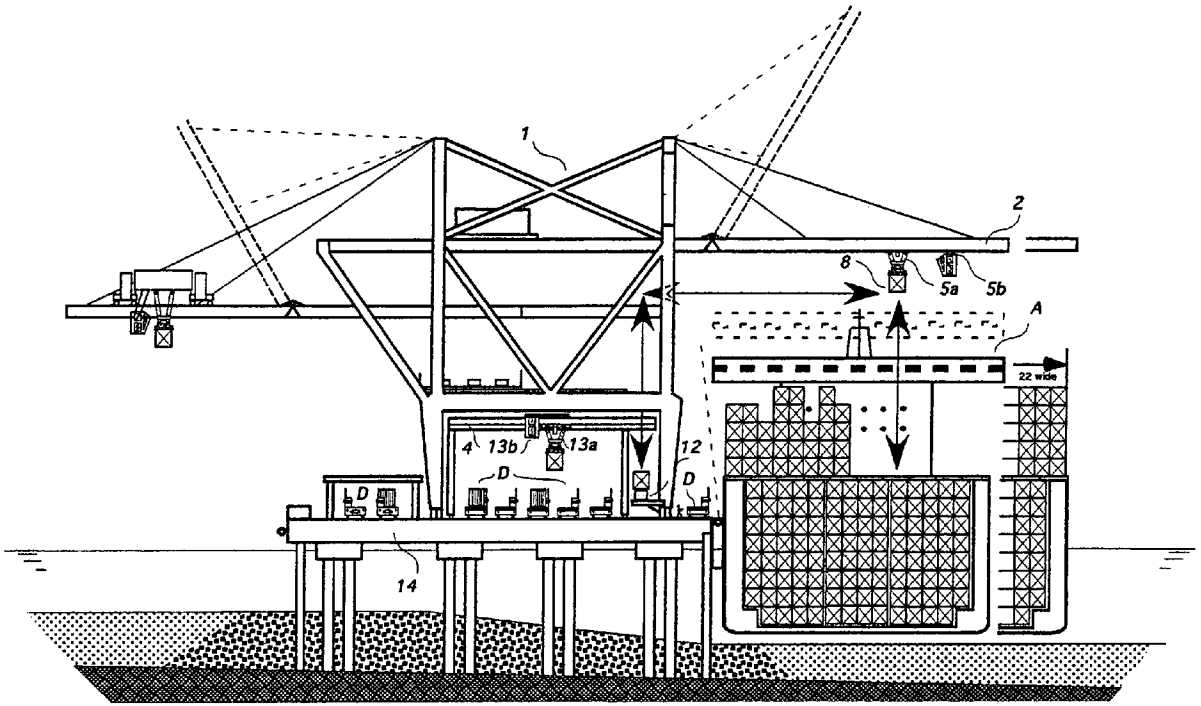
FIG. 5 is an explanatory elevational view, partly in section, of another embodiment of crane apparatus according to the present invention, showing the crane apparatus mounted on a standard-type pier and showing the transshipping of containers from a container vessel directly to over-the-ground equipment, such as, for example in this case, directly to manned, or automated, multi-trailer sets (MTS) and/or automated guided vehicles (AGVs) and/or trailer-trucks standing on the pier immediately under the cranes, and again all without the necessity for ground placement.
Figure 5A:
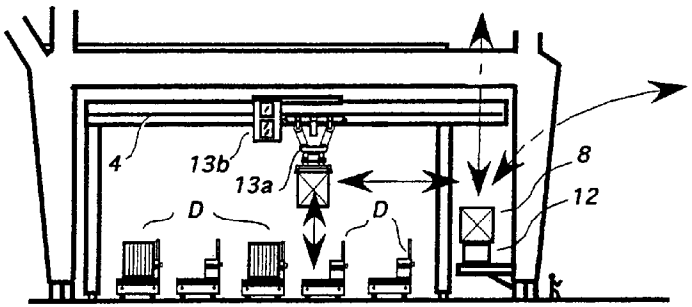
FIG. 5*a* is an enlarged view of part of the crane apparatus of FIG. 5 showing the unloading/loading cycle of the sibling crane.

FIGS. 5 and 5*a* illustrate an embodiment of the crane apparatus of the invention used to directly transship containers 8 between a container ship A and over-the-ground transfer equipment D such as, for example, multi-trailer-sets (MTS), automated guided vehicles (AGVs), single-container rapid transfer units, and/or trailer-trucks. In this embodiment, the start of the unloading cycle shown in FIG. 5 is the same as shown in FIG. 3, i.e., the trolley hoist/spreader 5*a* on the boom 2, under the control of an operator stationed in the independently mounted operator control cabin 5*b*, lifts the container 8 from the container ship A and transfers it to the fixed container receiving platform 12.

The on-going part of the unloading/loading cycle is shown in the enlarged view of FIG. 5*a*. In the case of trailer-trucks D, these can be driven, as is normal practice in marine container terminals, so that their trailers are aligned directly under the sibling RMG cranes 4. Under these conditions, the trolley/spreader hoists 13*a*, under the control of operators in the independently mounted operator control cabins 13*b*, can directly load the trailer-trucks D without necessarily having to move the sibling RMG cranes 4. The same can be said for AGV's or other single container, rapid transfer, units which can also be automatically located under the sibling RMG cranes 4, by the use of standard state-of-the-art automated control stops fed into their power drives.

With multi-trailer sets (MTS), and similar articulated, five or more, terminal wagon transfer systems, these can be randomly parked, within limits, under the cranes. Even if the said MTS are randomly parked under the parent quayside container cranes 1, their sibling RMG cranes 4, being independently rail mounted, can accurately position the containers 8 on any individual empty wagon. This is because, as stated previously, the trolley/spreader hoists 13*a* of the cranes 4 are able to move in both a transverse and longitudinal direction over pier the 14.

Figure 6:
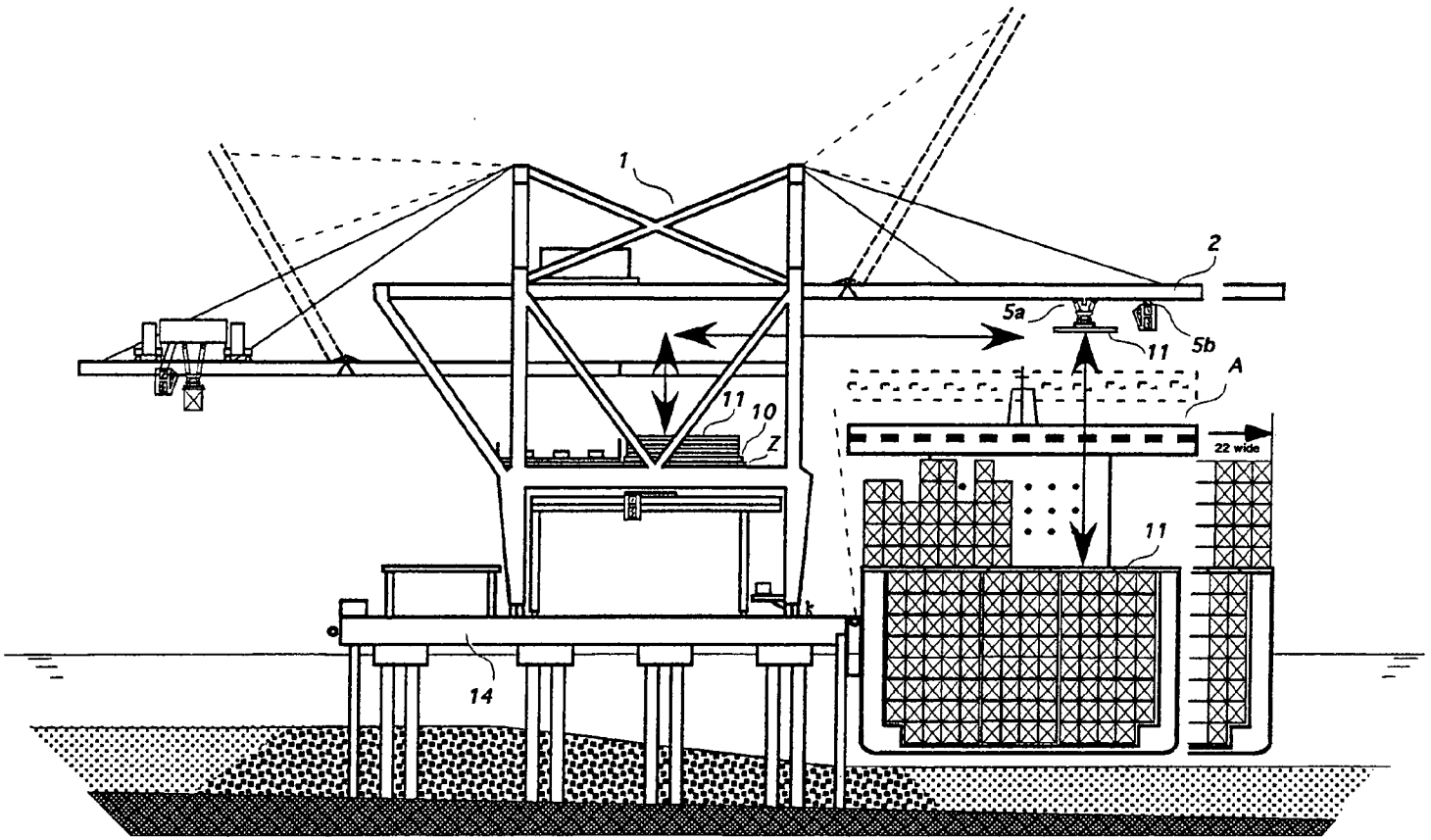
FIG. 6 is an explanatory elevational view, partly in section, of another embodiment of crane apparatus according to the present invention, showing the crane apparatus mounted on a standard-type pier and showing the transshipping of hatch covers from a container vessel directly to a hatch-cover platform within the parent quayside container crane without the necessity for ground placement of the hatch covers.

FIG. 6 illustrates an embodiment of the crane apparatus invention wherein the hatch covers 11 of the container ship A can be lifted by the trolley/spreader hoist 5*a* on the boom 2, under the control of an operator stationed in the independently mounted operator control cabin 5*b*, and placed on the hatch-cover receiving platform 10 supported by the platform bearing structure Z. This greatly shortens the cycle time as against lifting and placing the hatch covers at ground level.

FIG. 7 illustrates the same embodiments of the crane apparatus of the invention as shown in FIGS. 1 through 6, the only difference being that, instead of a pier 14 constructed on, for example, the slab, plinth and piling principle, the foundation in this case is a caisson 19. The heavy loads, both static and dynamic, created by, for example, five mobile parent quayside container cranes 1 operating at maximum cycle speed while unloading/loading a large container ship A, under certain conditions, may be better compensated for by a crane platform comprised of large, demountable, ballastable, trimmable, concrete caissons 19. Such caisson platforms 19, and their use, are described in detail in U.S. Pat. No. 6,017,617 by the same inventor, which is incorporated herein by reference.

Figure 8:
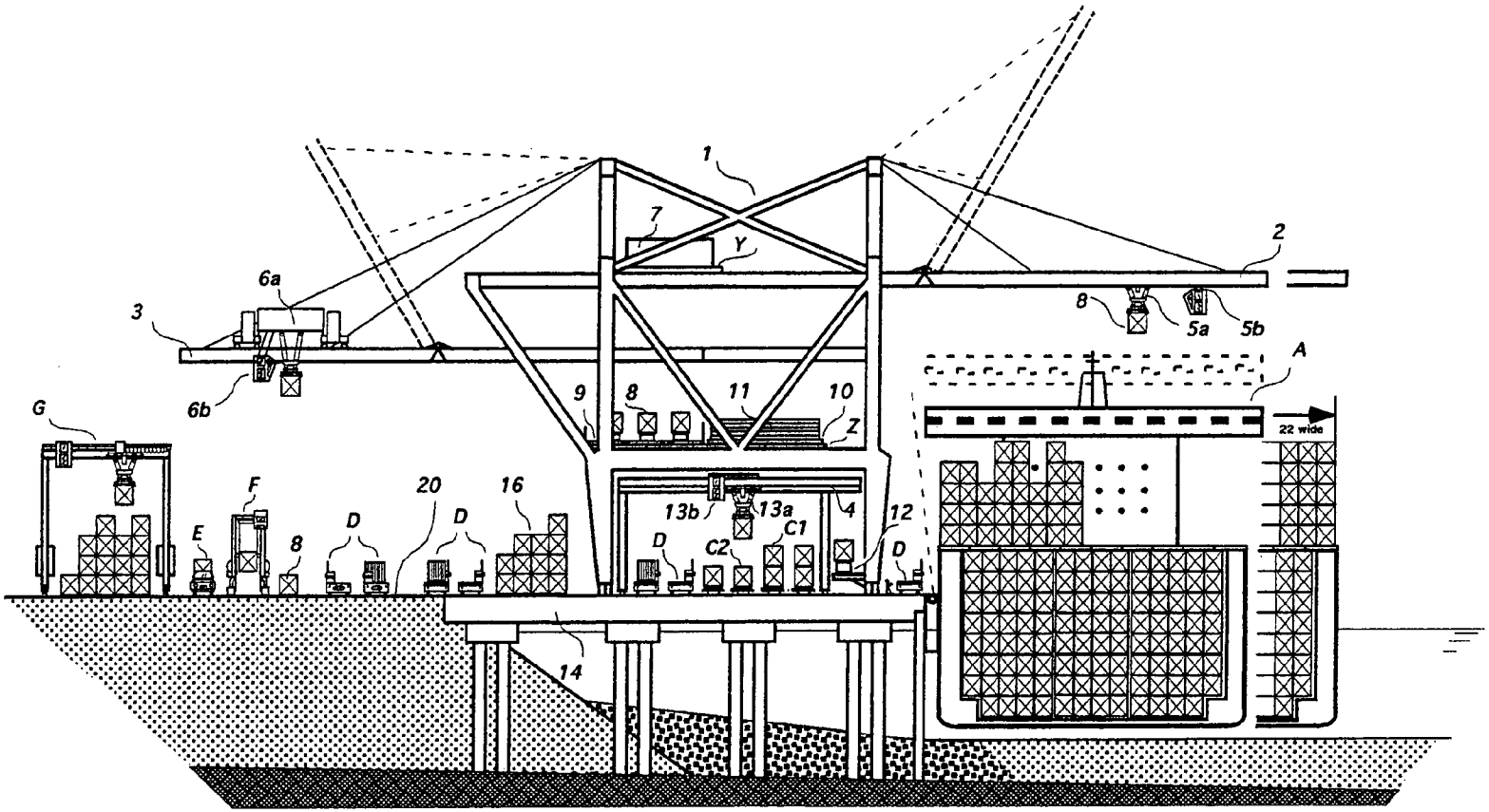
FIGS. 8 through 10 are explanatory elevational views, partly in section, of other embodiments of crane apparatus according to the present invention, showing the crane apparatus mounted on different support structures or foundations.
Figure 9:
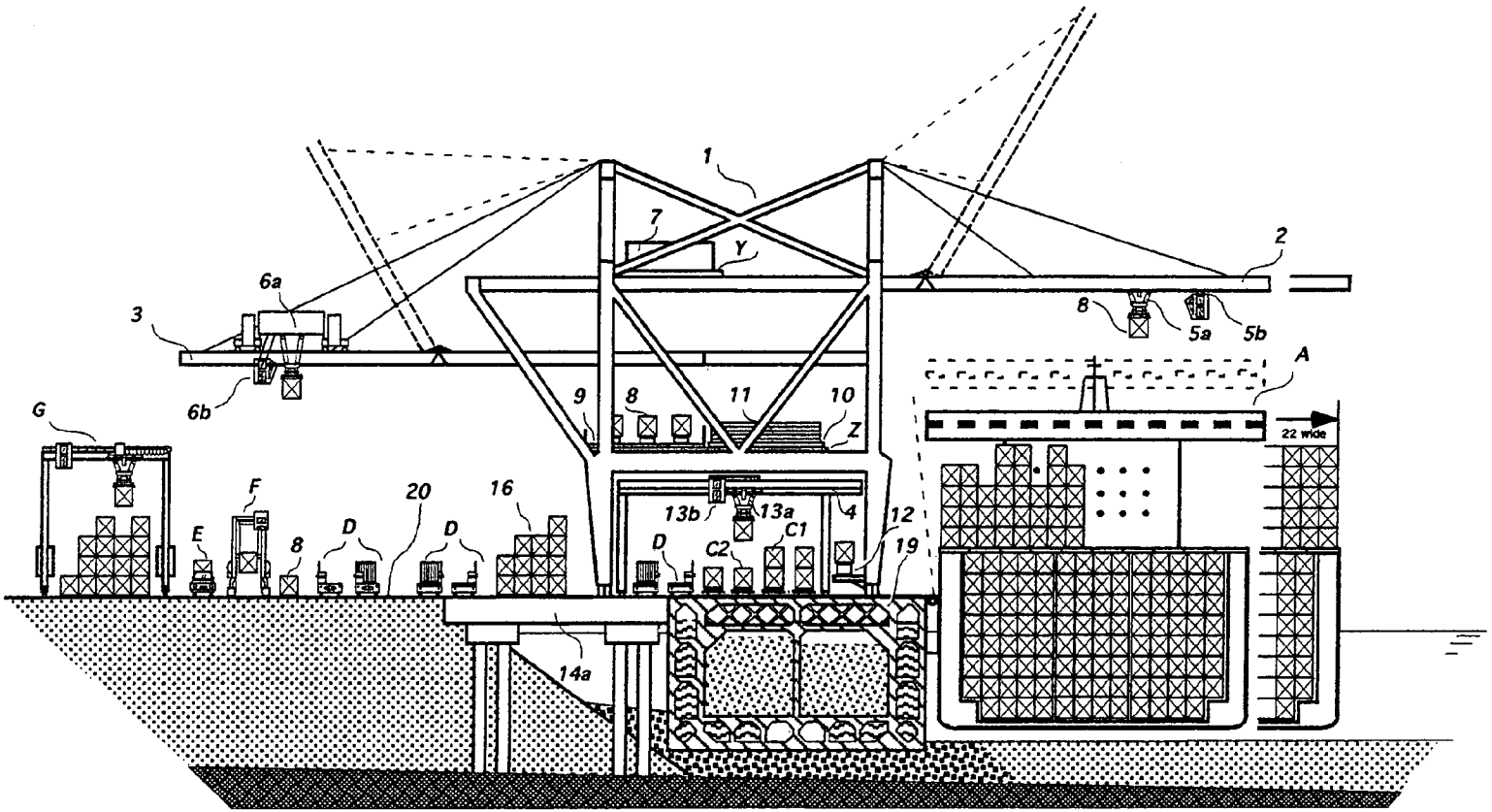
Figure 10:
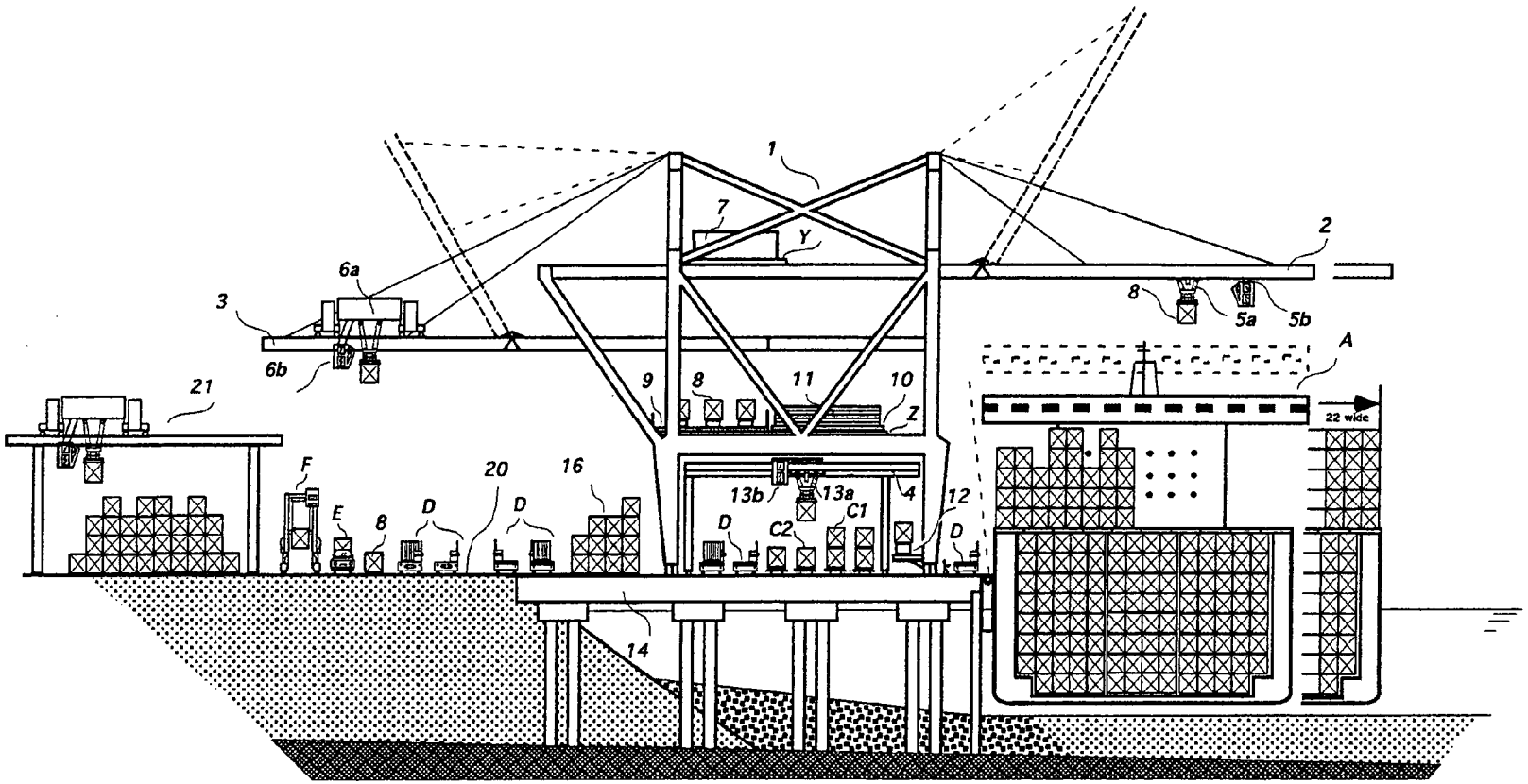

FIGS. 8, 9 and 10 show embodiments of the crane apparatus of the invention installed on wharves or bulkhead wharves 20. FIG. 8 shows a typical wharf or bulkhead wharf 20 built by standard construction. In this case, for example, the dock front is shown as being constructed by the plinth, slab and piling method. FIG. 9 shows, for example, the wharf or bulkhead wharf 20 constructed using caissons 19 together with a concrete apron 14*a*.

One difference between the embodiments of the invention shown in FIGS. 8, 9 and 10, as against that shown in FIG. 1, is that the fixed platform for storing restow containers is not required. With the added land available back from the dock face and cranes, the option exists as to whether to restow containers 16 on a fixed platform or on the ground.

Also with added backland being available with a wharf or bulkhead wharf installation 20, and as shown in FIGS. 8, 9 and 10, it is possible that a wider range of container moving-and-handling equipment can be utilized. The more restricted real estate available with piers 14 results in the over-the-ground equipment that can be used being limited as to type and numbers. In the case of wharves and bulkhead wharves 20, as can be seen in FIGS. 8, 9 and 10, other types of equipment can be used, especially those that require more room to maneuver, such as multi-trailer sets (MTS) E, rubber-tired gantries (RTGs) G, and straddle carriers F. Also readily usable in this category, but not shown, would be reach-stackers and top-picks.

All the direct transshipment functions that the parent quayside container cranes 1 and their sibling RMG cranes 4 are described as being able to execute in the embodiments of FIGS. 1-7 on piers 14, are capable of being executed on the wharves and bulkhead wharves 20 in the embodiments of FIGS. 8-10. The Poseidon™ crane system will be just as cost-effective and as efficient in terms of lifts per hour, and cycle time, whether installed on a pier, a wharf or a bulkhead wharf.

FIG. 10 differs from FIG. 8 only in that it shows the installation of automated overhead bridge cranes (OBCS) 21 for stacking containers in the terminal. The installation of the OBCs 21 reduces the handling cost per container and allows for a greatly increased stacking density per acre. Recent developments in this area in Singapore, Hong Kong and Antwerp, where backland is relatively restricted, have seen the installation of OBC systems resulting in a terminal efficiency in the order of 11,000 TEUs/acre/year. For comparison purposes, the efficiency of the Port of NY/NJ container terminals is in the order of 1,250 TEUs/acre/year.

Ideally, as shown in FIG. 10, the machine trolley/spreader hoist 6*a*, under the control of an operator in the operator control cabin 6*b*, would drop the container 8 to the ground as close to the backlegs of the cranes as possible. From there, 1-over-1 shuttle straddle carriers (such as those of Kalmar Industries) would only have to move the containers 8 a short distance to a point where the OBCs 21 can pick them up and transfer them into the stacks. The combined efficiencies of the Poseidon™ crane system, together with automated overhead bridge cranes in a stacking area as close as possible to these cranes, would result in the most efficient and cost-effective marine container terminal layout and design, especially in areas where backland is restricted.

Figure 11:
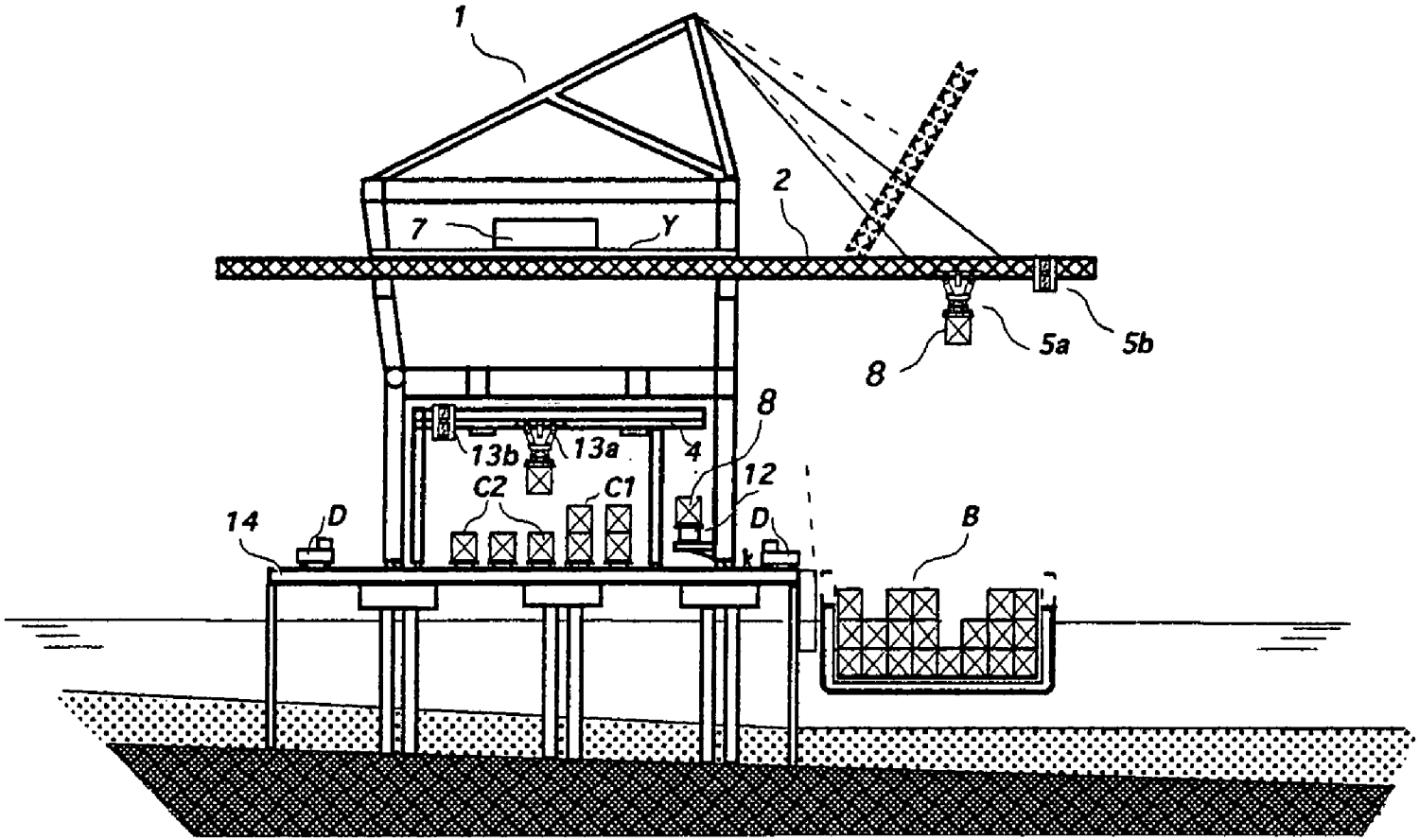
FIG. 11 is an explanatory elevational view, partly in section, of a further embodiment of crane apparatus according to the present invention, showing a smaller version of crane apparatus and showing the transshipping of containers from a container barge directly to the railway mode such as, for example in this case, to single-stack and double-stack rail-cars without the necessity for ground placement.

FIG. 11 shows an embodiment of the crane apparatus of the invention which is smaller, and lower in height, than the embodiments described heretofore. This embodiment of crane apparatus also has parent quayside container cranes 1 and sibling RMG cranes 4 and is designed to transship containers directly between container barges B and double stack C1, and/or single stack C2, container rail-cars that are part of cuts of container unit-trains positioned immediately under the cranes. As it does not have to transship containers 8 from large containers vessels A, as shown in FIGS. 1-3 and 5-10, this combination of cranes can be of a far more compact design and therefore cost considerably less to construct.

This embodiment of the invention can also be installed on piers 14, as shown in FIG. 11, or on a wharf or bulkhead wharf, similar to those shown in FIGS. 8, 9 and 10.

While the present invention has been described with reference to presently preferred embodiments thereof, other embodiments as well as obvious variations and modifications to all the embodiments will be readily apparent to those of ordinary skill in the art. The present invention is intended to cover all such embodiments, variations and modifications that fall within the spirit and scope of the appended claims.

I claim:

1. A method for transshipping containers from a vessel moored alongside a foundation to over-the-ground vehicles without ground placement of the containers, the method comprising the steps of:

unloading containers from a vessel moored alongside a foundation using a parent crane that is displaceable on a trackway lengthwise along the foundation and placing some containers on a first platform affixed to the parent crane and placing other containers on a second platform of the parent crane;

transferring containers that were placed by the parent crane on the first platform directly onto over-the-ground vehicles, without intervening ground placement of the containers, using a sibling crane that is displaceable independently of the parent crane lengthwise along the foundation at ground level beneath the parent crane; and transferring containers that were placed by the parent crane on the second platform directly onto another vessel moored alongside the foundation or directly onto over-the-ground vehicles, without intervening ground placement of the containers, using the parent crane.

2. A method according to claim 1; wherein the step of transferring containers from the second platform comprises transferring the containers from the second platform directly onto another vessel moored alongside the foundation.

3. A method according to claim 2; wherein the step of transferring containers that were placed on the first platform comprises transferring the containers from the first platform directly onto rail-cars.

4. A method according to claim 3; wherein the step of transferring containers that were placed on the first platform further comprises displacing the sibling crane lengthwise along the foundation while the parent crane remains in a fixed position along the foundation to transfer the containers onto different ones of the rail-cars.

5. A method according to claim 4; wherein the rail-cars are disposed on parallel sets of rail tracks that run beneath the sibling crane.

6. A method according to claim 2; wherein the step of transferring containers that were placed on the first platform comprises transferring the containers from the first platform directly onto trailer-trucks, multi-trailer sets or automated guided vehicles.

7. A method according to claim 1; wherein the step of transferring containers that were placed on the second platform comprises transferring the containers from the second platform directly onto over-the-ground vehicles.

8. A method according to claim 7; wherein the over-the-ground vehicles comprise rail-cars.

9. A method according to claim 7; wherein the over-the-ground vehicles comprise trailer-trucks, multi-trailer sets or automated guided vehicles.

10. A method according to claim 1; wherein the step of transferring containers that were placed on the first platform comprises transferring the containers from the first platform directly onto rail-cars.

11. A method according to claim 10; wherein the step of transferring containers that were placed on the first platform further comprises displacing the sibling crane lengthwise along the foundation while the parent crane remains in a fixed position along the foundation to transfer the containers onto different ones of the rail-cars.

12. A method according to claim 11; wherein the rail-cars are disposed on parallel sets of rail tracks that run beneath the sibling crane.

13. A method according to claim 1; wherein the step of transferring containers that were placed on the first platform comprises transferring the containers from the first platform directly onto trailer-trucks, multi-trailer sets or automated guided vehicles.

* * * * *